US012728959B2

(12) United States Patent
Rooke

(10) Patent No.: US 12,728,959 B2
(45) Date of Patent: Sep. 8, 2026

(54) MARINE DRIVER SYSTEM

(71) Applicant: Women at Work Group Pty Ltd, Dingley (AU)

(72) Inventor: Greg Rooke, Dingley (AU)

(73) Assignee: Women at Work Group Pty Ltd., Dingley (AU)

( * ) Notice: Subject to any disclaimer, the term of this patent is extended or adjusted under 35 U.S.C. 154(b) by 283 days.

(21) Appl. No.: 18/686,378

(22) PCT Filed: Aug. 25, 2022

(86) PCT No.: PCT/AU2022/051031

§ 371 (c)(1),
(2) Date: Feb. 23, 2024

(87) PCT Pub. No.: WO2023/023803

PCT Pub. Date: Mar. 2, 2023

(65) Prior Publication Data

US 2025/0074550 A1 Mar. 6, 2025

(30) Foreign Application Priority Data

Aug. 25, 2021 (AU) ..... 2021221650

(51) Int. Cl.
*B63B 21/48* (2006.01)
*B63B 21/26* (2006.01)

(52) U.S. Cl.
CPC ..... *B63B 21/48* (2013.01); *B63B 21/26* (2013.01)

(58) Field of Classification Search
CPC ..... B63B 21/26; B63B 21/48
See application file for complete search history.

(56) References Cited

U.S. PATENT DOCUMENTS 2,491,564 A * 12/1949 Iversen ..... B63B 21/48 114/311
6,041,730 A 3/2000 Oliverio et al.
(Continued)

FOREIGN PATENT DOCUMENTS

WO 2023023803 A1 3/2023

OTHER PUBLICATIONS

International Search Report, PCT Application No. PCT/AU2022/051031, mailed Nov. 23, 2022, 4 pgs.
(Continued)

*Primary Examiner* — Joseph W Sanderson
(74) *Attorney, Agent, or Firm* — TraskBritt

(57) ABSTRACT

A method of driving a work body to an obtuse angle relative to a drive body by providing a pivotal mounting of a work body such that it can pivot up to 180 degrees, mounting a drive body at a spaced position above the pivotal mount of the work body, pivotally mounting a first end of an elongated lever arm and pivotally mounting the distal second end to the operative end of the linear actuator and providing a drive arm from the work body to a leverage position on the lever arm between the first and second end. Also, the drive arm is pivotally mounted by the drive arm mount to the lower drive body and a sliding pivot slot pin is received in the linear slot extending along a portion of the drive arm to define a direction and limitation of movement of the drive arm relative to the lever arm.

18 Claims, 18 Drawing Sheets

(56) References Cited

U.S. PATENT DOCUMENTS

| | | | | |
|---|---|---|---|---|
| 7,971,548 | B2 * | 7/2011 | Kuenzel | B63B 21/26 114/294 |
| 8,550,023 | B1 * | 10/2013 | Quail | B63B 21/26 114/294 |
| 8,800,465 | B1 * | 8/2014 | Quail | B63B 21/26 114/294 |
| 9,284,024 | B2 * | 3/2016 | Kuenzel | B63B 21/26 |
| 9,745,022 | B1 * | 8/2017 | Kuenzel | B63B 21/26 |
| 10,526,050 | B1 * | 1/2020 | Turek | B63B 21/26 |
| 10,940,919 | B2 * | 3/2021 | Rooke | B63B 21/48 |
| 10,994,811 | B1 * | 5/2021 | Smith | B63B 21/26 |
| 2009/0223429 | A1 * | 9/2009 | Kuenzel | B63B 21/26 114/230.13 |
| 2009/0223430 | A1 * | 9/2009 | Kuenzel | B63B 21/26 114/230.13 |
| 2015/0298771 | A1 * | 10/2015 | Kuenzel | B63B 21/26 114/295 |
| 2017/0233039 | A1 * | 8/2017 | Kuenzel | B63B 21/26 114/295 |
| 2020/0017171 | A1 | 1/2020 | Rooke | |
| 2021/0129945 | A1 * | 5/2021 | Smith | B63B 21/26 |
| 2024/0059377 | A1 * | 2/2024 | Ward | B63B 21/29 |
| 2025/0026450 | A1 * | 1/2025 | Ward | B63B 21/29 |

OTHER PUBLICATIONS

International Written Opinion, PCT Application No. PCT/AU2022/051031, mailed Nov. 23, 2022, 8 pgs.

* cited by examiner

MARINE DRIVER SYSTEM

CROSS-REFERENCE TO RELATED APPLICATIONS

This application is a national phase entry under 35 U.S.C. § 371 of International Patent Application PCT/AU2022/051031, filed Aug. 25, 2022, designating the United States of America and published as International Patent Publication WO 2023/023803 A1 on Mar. 2, 2023, which claims the benefit under Article 8 of the Patent Cooperation Treaty of Australian Patent Application Serial No. 2021221650, filed Aug. 25, 2021.

TECHNICAL FIELD

This disclosure relates to a marine driver system. The disclosure has been developed primarily for use to drive a work body such as an anchoring system at an obtuse angle relative to a drive body and will be described hereinafter with reference to this application. However, it will be appreciated that the disclosure is not limited to this particular field of use.

BACKGROUND

Marine systems that work below the surface of the water, such as anchor systems, use the drag of the water or contact with the waterbed to undertake their function. Such drag or frictional contact are detrimental to the marine vessel when it is used to travel across the water. Therefore, any part of the anchor system that extends into the water to be effective as an anchor must be removed from the water to minimize the effectiveness of the marine vessel travelling across the water.

Anchor systems can be a heavy body attached by an anchor chain having a shape with a cutting edge that digs into the waterbed. By releasing the anchor to engage the waterbed and then pulling on the anchor chain, the cutting edge digs down into the waterbed to provide a better grip and, therefore, a better anchoring effect. The anchor system can instead be a parachute type device at the end of a tether connection to the boat.

Each of these systems rely on a pulling action by a mechanized anchor system. A mechanized anchor system that can provide a pulling force is a winch on the boat that hauls in the anchor.

However, there are other anchors required when the anchor cannot reach the waterbed in deep water or when the waterbed is too shallow and too soft.

A first type of anchor that does not need to engage the waterbed is a rigid framed structure that is inserted in the water behind the boat to cause drag. This is generally better than a parachute type anchor as the effectiveness of the parachute anchor is too variable dependent on the varying openness of the parachute.

A second type of anchor is a spike anchor that is driven into a shallow waterbed. It requires a deep penetration of the waterbed to provide the improved anchoring effectiveness.

These types of anchors require positive thrust mechanism of the work body rather than a pulling force provided by a winch.

Generally positive thrust mechanisms are provided by a rotating arm. However, a rotating arm provides a rotational force and is limited in its torque.

Known prior art marine driver systems have the problems of:

a) trying to use angular drive to provide linear force;

b) limited effectiveness of use due to the geometry of the drive;

c) not allowing use of linear drives;

d) providing low positive thrust power;

e) subject to bounce against a waterbed;

f) not strong in its return action; and g) likelihood to not be strong enough in return actions at various angles.

The problems of the structure of the known spike anchor systems include:

i) 12-volt hydraulic pump and lines to be fitted internally into boat, ii) Arms tend to wobble around and do not lock into place when in closed position, particularly as they age;

iii) Once spike has been driven down it does not move up or down to follow the movement of the boat, e.g., due to waves. Systems that redrive using hydraulic pressure are flawed;

iv) If boat or tide drops once deployed, full load is forced on spike, which can cause it to become stuck (e.g., in the mud);

v) No sensor is used to detect soft bottom and spike over deploys and becomes stuck in soft bottom, e.g., mud; and vi) No dampener system so when deployed in rough water, arms bounce around violently.

This disclosure seeks to provide a marine driver system that will overcome or substantially ameliorate at least one or more of the deficiencies of the prior art, or to at least provide an alternative.

It is to be understood that, if any prior art information is referred to herein, such reference does not constitute an admission that the information forms part of the common general knowledge in the art, in Australia or any other country.

BRIEF SUMMARY

According to a first aspect of this disclosure, a marine driver system is provided for rotatably driving a work body relative to a drive body, the driver system including a drive body, a work body and a linear actuator for driving the work body through a lever arm.

The drive body substantially extends in a linear direction forming a reference axis with the work body pivoted at one end to the drive body at or near the reference axis and in use on a boat is able to be pivoted between a storage position out of the water and an operative position in the water. A linear actuator is mounted to the work body at a position spaced to the pivot connection of the work body to the drive body.

The marine driver system can have a lever arm with first and second pivot points at distal ends. A drive arm pivotally can be mounted on the lever arm in a position between the first and second pivot points to provide a levered drive of the drive arm by the linear actuator wherein the work body is drivably rotatable by the linear actuator substantially 180 degrees or at least an obtuse angle relative to the reference axis to provide a working drive action and returnable to a substantially adjacent alignment when rotated back to a storage position.

This disclosure of a marine driver system provides the benefit of providing an effective positive drive that is reversible out of water to a storage position and will not have mechanism become wedged.

The disclosure provides a marine driver system for driving a work body pivotally connected to a drive body, the driver system including: a drive body substantially extending in a linear direction forming a reference axis; a work body pivoted at one end to the drive body at or near the reference axis; a linear actuator having first and second opposing ends and mounted at the first end to the work body at a position spaced to the pivot connection of the work body to the drive body; a lever arm having first and second pivot points at respective distal ends of the lever arm, the lever arm pivotally mounted at the first pivot point to the drive body and pivotally mounted at the second pivot point to the second end of the linear actuator; a drive arm pivotally mounted at one end on the lever arm and pivotally connected at the other end of the drive arm to the work body; wherein drive or retraction of the linear actuator provides a levered drive of the drive arm and driving or retracting of the connected work body.

According to a further aspect of the disclosure, the marine driver system can be provided with the drive arm including a guide mechanism allowing for limited relative movement of the drive arm to the lever arm and a resilient mechanism wherein the work body is able to move resiliently relative to the actuator and/or drive arm over a limited compressive distance and self-return to the operative position.

The guide of the drive arm can include a guide channel for receiving a guide pin guide to define the allowed limited relative movement of the drive arm to the lever arm.

In another form the guide of the drive arm can include a guide rail for engaging a guide rail member to define the allowed limited relative movement of the drive arm to the lever arm.

The resilient mechanism can include a spring and, in particular, can be a spring that encircles the drive arm.

This disclosure of a marine driver system provides the benefit of avoiding any damage by bounce and continues effective working by resiliently returning to operative position.

The work body of the marine driver system can be one of:

a) a rigid frame fan anchor; or b) a low water spike anchor.

In one embodiment, there is provided a spike anchor system having a spike for driving into a waterbed when in use on a boat in shallow waters.

A rotating work frame is pivotally mounted at one end to a drive body substantially extending in a linear direction forming a reference axis, and wherein the spike is pivotally mounted to a second distal end of the drive body. A linear actuator mounted to the work body at a position spaced to the pivot connection of the work frame to the drive body and drives the work body including the spike through a lever arm having first and second pivot points at distal ends with a drive arm pivotally mounted on the lever arm in a position between the first and second pivot points to provide a levered drive of the drive arm by the linear actuator.

In this way the spike can be drivably pivoted between a storage position out of the water and an operative position in the water.

In one embodiment, the work frame includes a parallelogram drive frame that extends from the pivot connection of the drive body with the spike pivotally connected from the other end. In this way pivoting of the parallelogram drive frame provides a vertically downward driving force of the spike into a shallow bed below the boat.

The method of driving a work body to an obtuse angle relative to a drive body is provided by the steps of.

providing a pivotal mounting of a work body such that it can pivot up to 180 degrees;

mounting a drive body at a spaced position above the pivotal mount of the work body;

pivotally mounting a first end of an elongated lever arm and pivotally mounting the distal second end to the operative end of the linear actuator; and providing a drive arm from the work body to a leverage position on the lever arm between the first and second end.

In this way, the work body is drivably rotatable up to substantially 180 degrees or at least an obtuse angle relative to the reference axis to provide a working drive action and returnable to a substantially adjacent alignment when rotated back to a storage position.

The marine driver system of this disclosure provides one or more of the benefits of:

a) rotation up to 180 degrees;

b) being readily reversible so as to provide drive and retraction by the same mechanism;

c) no overdrive in reverse when starting from the up or stored position;

d) no ability to clash with the bottom arm pivot point in the full lock-down position;

e) still being able to lock-in with retractable force in the closed position;

f) ability to absorb blunt force impact to the actuator drive pin; and g) using a geometric lever system to transfer a greater range of movement without increasing actuator stroke length.

Other aspects are also disclosed.

BRIEF DESCRIPTION OF THE DRAWINGS

Notwithstanding any other forms that may fall within the scope of this disclosure, embodiments of the disclosure will now be described, by way of example only, with reference to the accompanying drawings in which.

DETAILED DESCRIPTION

Figure 1:
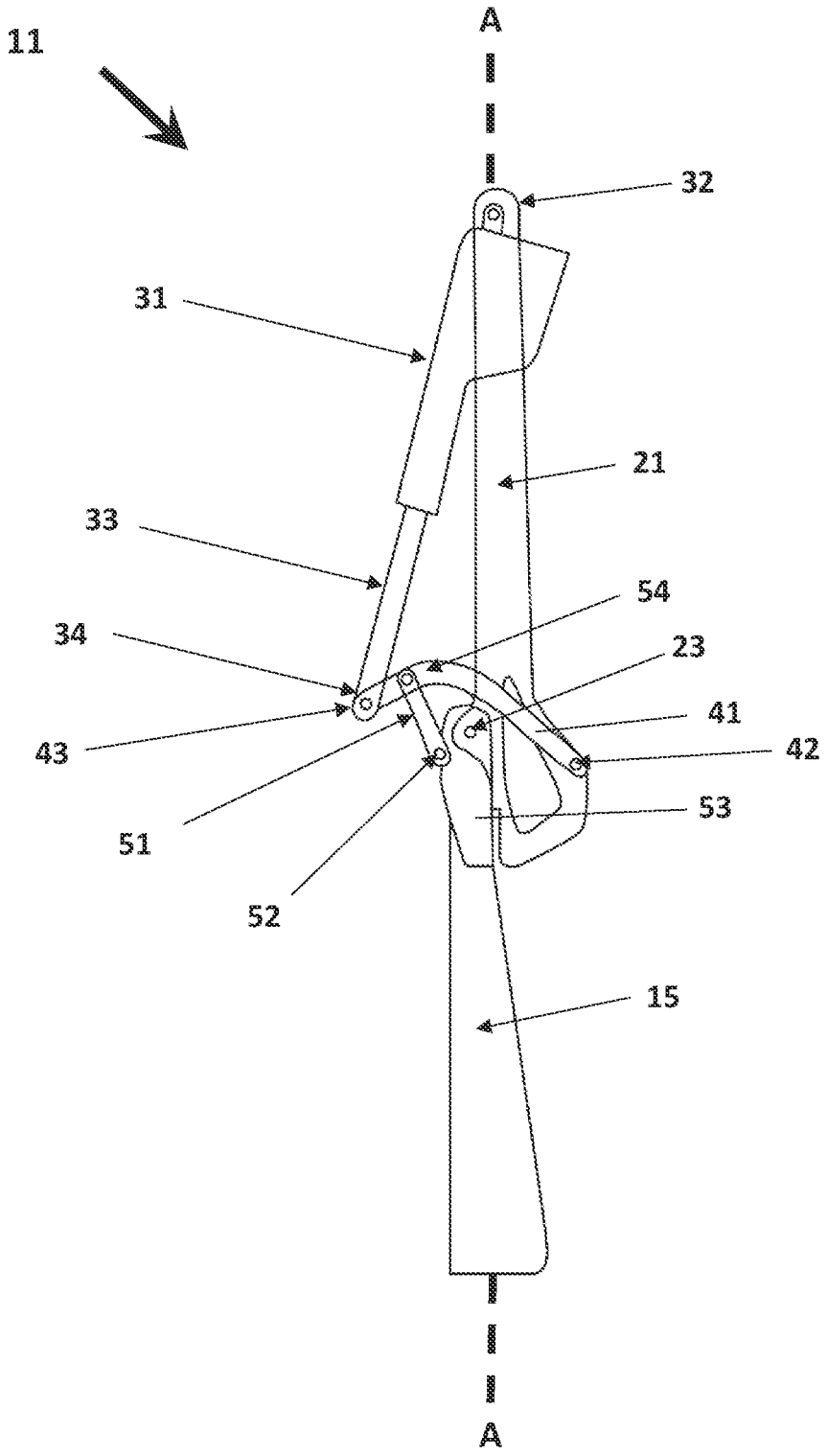
FIGS. 1 and 2 are diagrammatic vertical cross-sectional views of a marine driver system able to drive a work body at an obtuse angle relative to a drive body in accordance with an embodiment of this disclosure.

It should be noted in the following description that like or the same reference numerals in different embodiments denote the same or similar features.

Referring to the drawings, the ability to drive a work body at an obtuse angle relative to a drive body is shown.

Development

A drive mechanism was needed to provide a drive mechanism that could rotate through a full 180 degrees whilst being compact and in-line (straight up and down). However, there is nothing suitable that was functional and suited driving work bodies in a marine setting due to the required size and forces and orientations required for use in the marine setting.

Some features of a drive mechanism according to the disclosure include:

- rotation through 180 degrees;
- no overdrive in reverse when starting from the up or stored position;
- not being able to clash with the bottom arm pivot point in the full lock-down position;
- still being able to lock-in with retractable force in the closed position;
- having the ability to be able to absorb blunt force impact to the actuator drive pin; and
- a geometric lever system to transfer a greater range of movement without increasing actuator stroke length.

It was found that a simple use of a linear actuator in a rotating system resulted in the actuator striking the bottom arm pivot point of the actuator when in full down position. An option was to lengthen the pivot point on the arms but this caused issues when locking into place. The actuator was now trying to drive the arms backwards rather than forwards and resulted in the arms locking and the actuator overloading.

Solving the issue of the bottom pivot point striking the actuator could not overcome the problem of stopping the overlocking in the stored position. There was also the issue of blunt force to the bottom pivot point of the actuator and the actuator was pulling up on the pivot point and not locking the arms in place.

The next development was the concept of using guide arms that had a fixed rotation. This was provided by adding rigid drive arms 51 and fabricating a pivot block 53 to attach the arms to. This was not a simple matter to get the geometrics right so it would close up and be functional and drive the full 180 degrees.

A lever arm 41 was used to offset the connection 54 of the drive arm 51 to the connection 34 of the linear actuator 31.

The new mechanism pulled the arms up and locked them in place as there was lateral force on the arms pulling it hard back against the actuator in the closed position. As the actuator pulls up to the home position the force is transferred to the rigid drive arm. This new mechanism provided sufficient clearance in the down position as there was sufficient clearance for the pivot points.

The marine driver system for rotatably driving a work body relative to a drive body, the driver system including a drive body 21 substantially extending in a linear direction forming a reference axis and a work body 15 pivoted at one end to the drive body at or near the reference axis and in use on a boat is able to be pivoted between a storage position out of the water and an operative position in the water. A linear actuator 31 is mounted to the work body 15 at a position spaced to the pivot connection of the work body to the drive body on a lever arm 41 having first and second pivot points at distal ends. The mount is by a drive arm 51 pivotally mounted on the lever arm 41 in a position between the first and second pivot points to provide a levered drive of the drive arm by the linear actuator wherein the work body is drivably rotatable by the linear actuator substantially 180 degrees or at least an obtuse angle relative to the reference axis to provide a working drive action and returnable to a substantially adjacent alignment when rotated back to a storage position.

It has been found that an unexpected substantial improvement is provided by at least a combination of one or more of the following features:

a) only needing use of a linear actuator;
b) pivotal mounting of the linear actuator so to allow self-adjustment of the drive angle of the actuator piston;
c) shock absorbing mounting of the linear actuator to minimize damage when work body hits a resistive force;
d) intermediate pivotal connection of the actuator piston of the linear actuator to a pivotally mounted lever arm;
e) the lever arm having pivotal mounting on one side of the reference drive body and connection to the work body and the actuator piston on the other side to avoid fouling and ensure smooth drive and retraction without wedging;
f) connection of a drive arm between the lever arm and the work body rather than direct connection to the linear actuator;
g) a curved geometry to the lever arm to transfer a greater range of movement without increasing actuator stroke length;
h) a non-linear connection of the drive arm along the curved geometry lever arm relative to the pivotal connection of the lever arm;
i) a bounce mechanism of the drive arm to minimize damage when work body hits a resistive force; and
j) a pivotal connection of the drive arm to the work body.

Bounce Mechanism

With the issues of the arms locking and the clearance of pivot point resolved the issue of blunt force to the bottom of the actuator pin was of concern.

Figure 3:
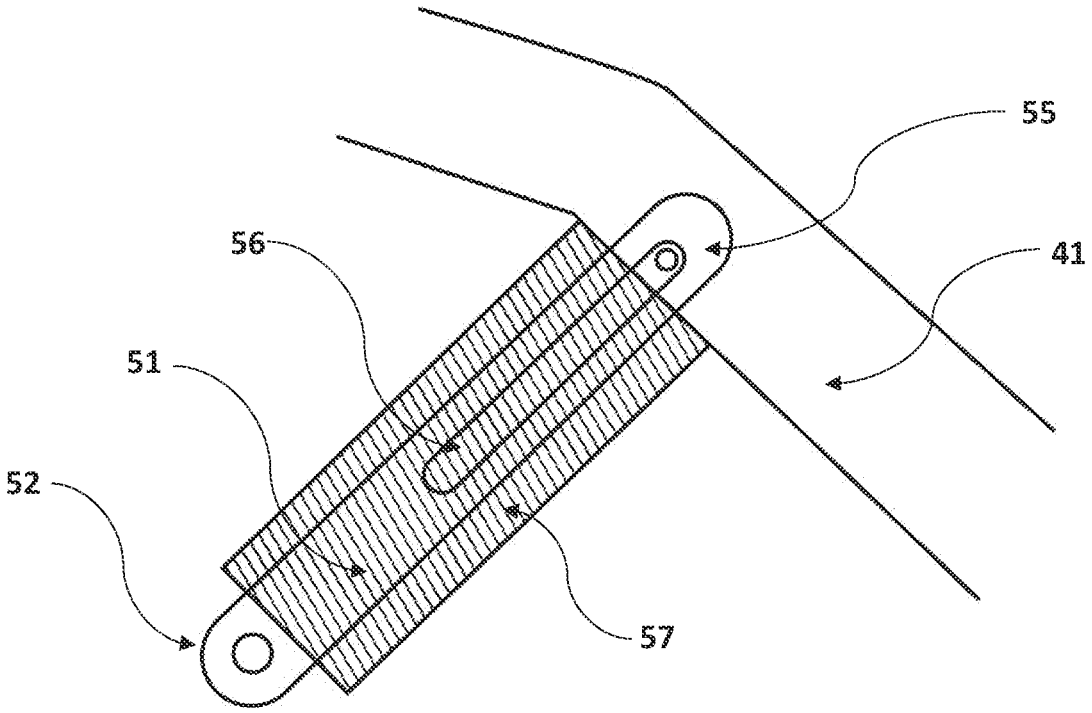
FIG. 3 is a diagrammatic vertical cross-sectional view of bounce mechanism for use in the marine driver system of FIG. 1.

As shown in FIG. 3, this was resolved by cutting a sliding slot 56 in the drive arm 51 while remaining pivotally connected to the lever arm 41. This was achieved by the drive arm 51 being pivotally connected by the drive arm mount 52 to the lower drive body and a sliding pivot slot pin 55 being received in the linear slot 56 extending along a portion of the drive arm 51 to define a direction and limitation of movement of the drive arm 51 relative to the lever arm 41.

The sliding pivot slot pin 55 also ensures available pivotable movement of the drive arm relative to the lever arm to ensure smooth leverage by the non-linear lever arm and avoidance of any locking of the mechanism. A high compression spring 57 is mounted around the drive arm 51 between the lever arm and the drive arm mount. This allows the springs to compress allowing any force to the mechanism to be dissipated and no damage to the driver system or actuator. It also ensures automatic resilient return to the optimum operative position without any requirement to reset.

Figure 8:
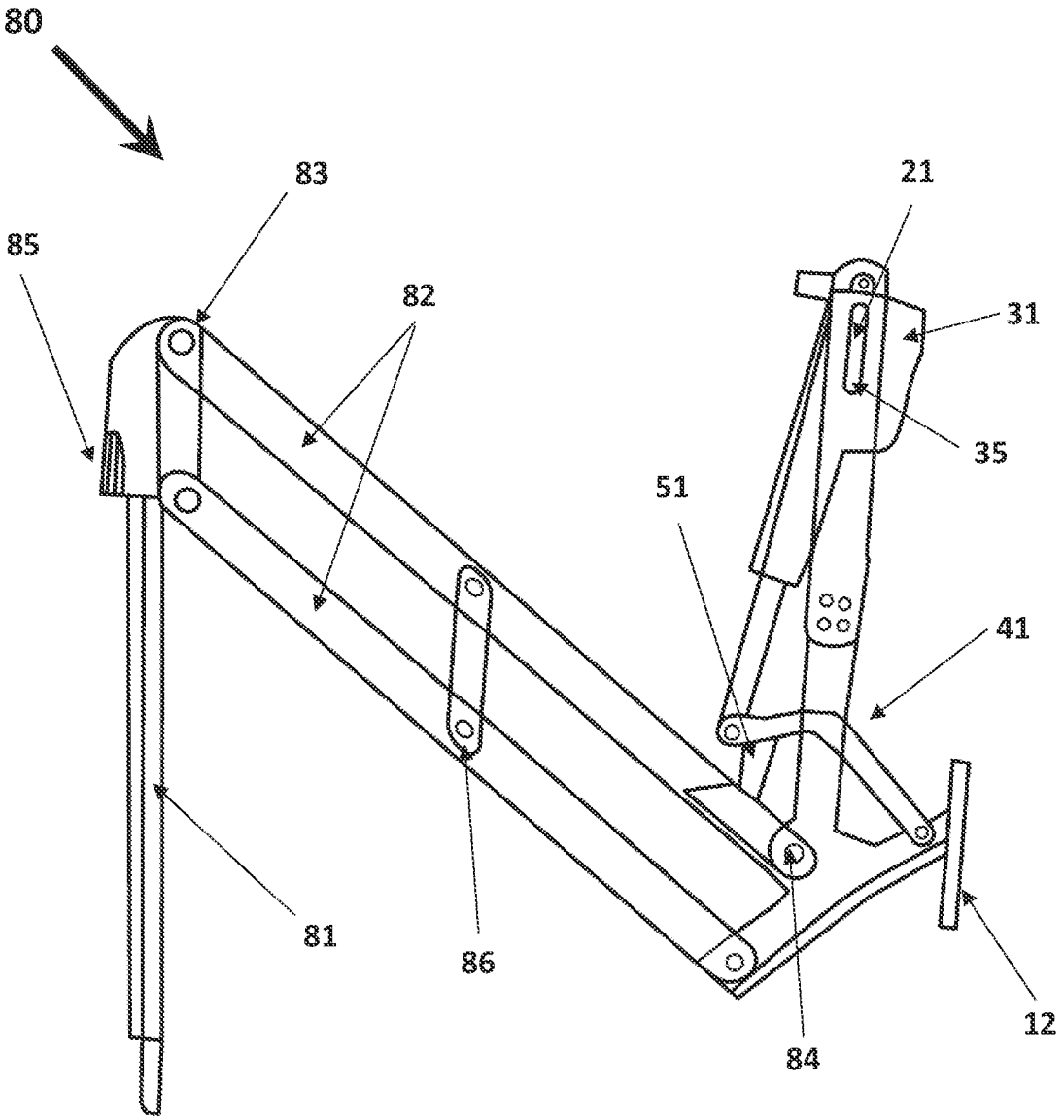
FIG. 8 is a diagrammatic view of operation of a work body in the form of a rigid spike anchor for use in the marine driver system to drive the rigid spike into the waterbed in shallow waters in accordance with an embodiment of this disclosure.
Figure 9:
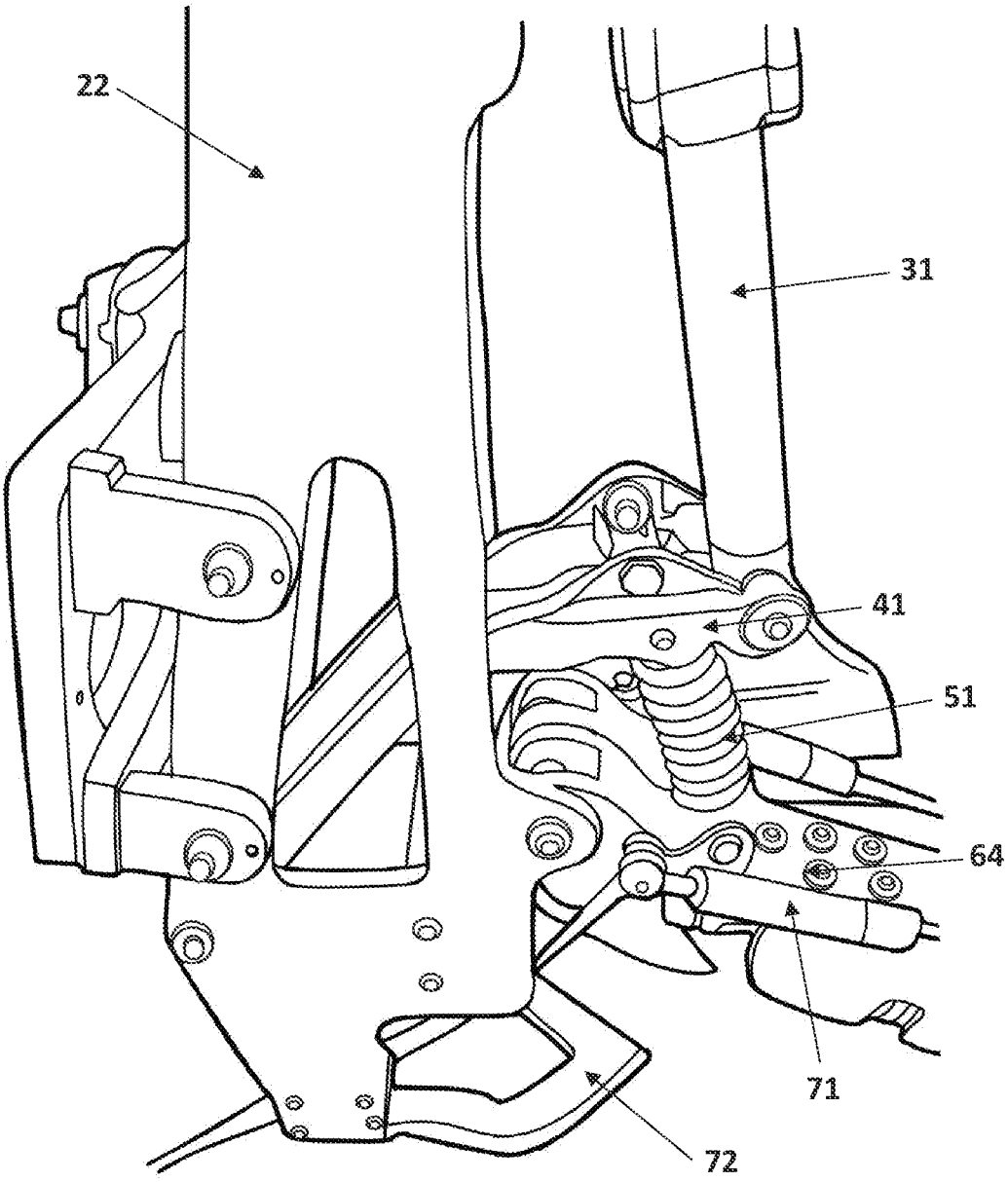
FIGS. 9 to 12 are photographic views of an embodiment of the marine driver system to drive the openable fan to an obtuse angle relative to a drive body in accordance with an embodiment of this disclosure such as shown in FIGS. 1 to 3 and FIGS. 4 to 7.
Figure 10:
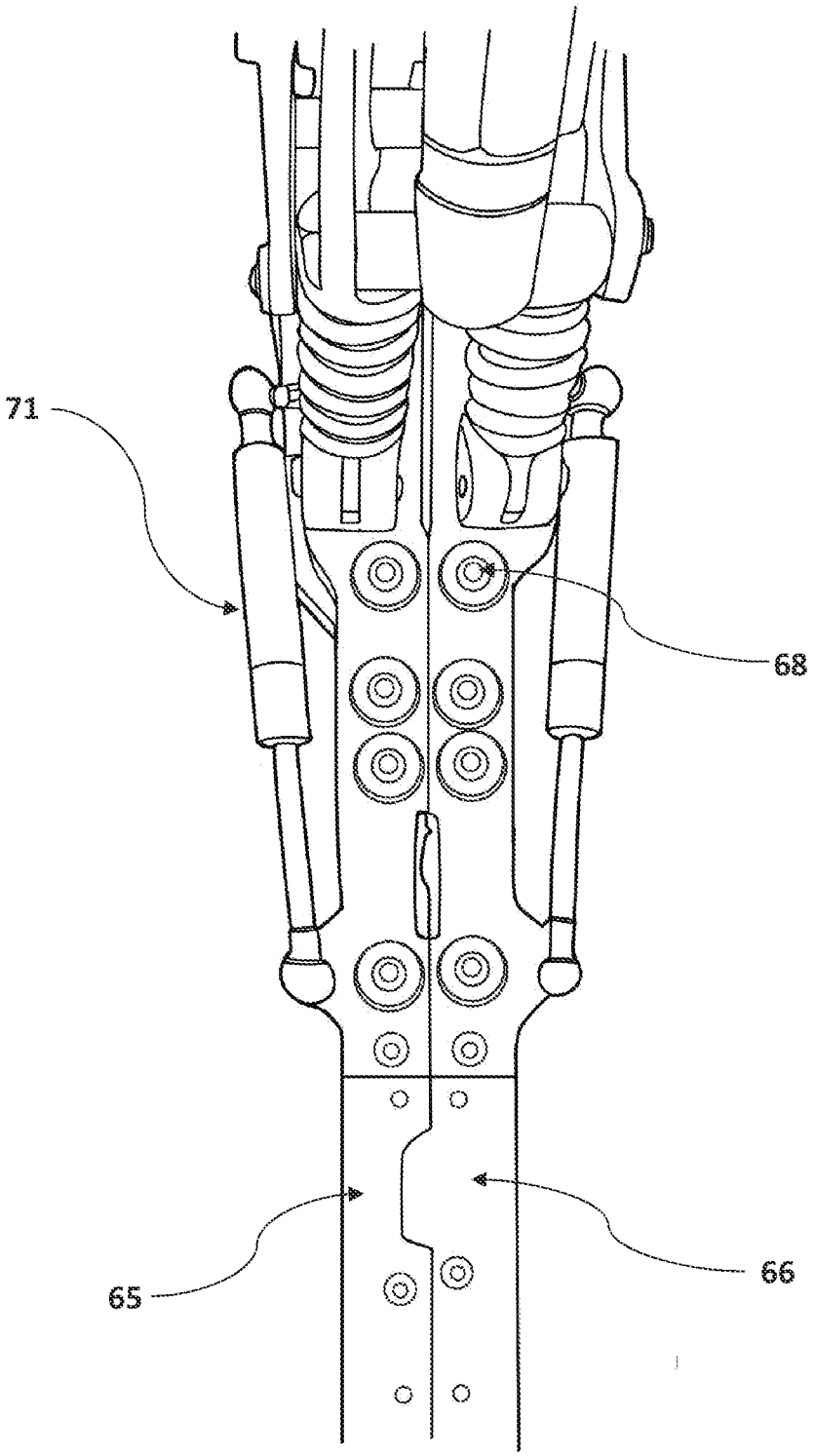
Figure 11:
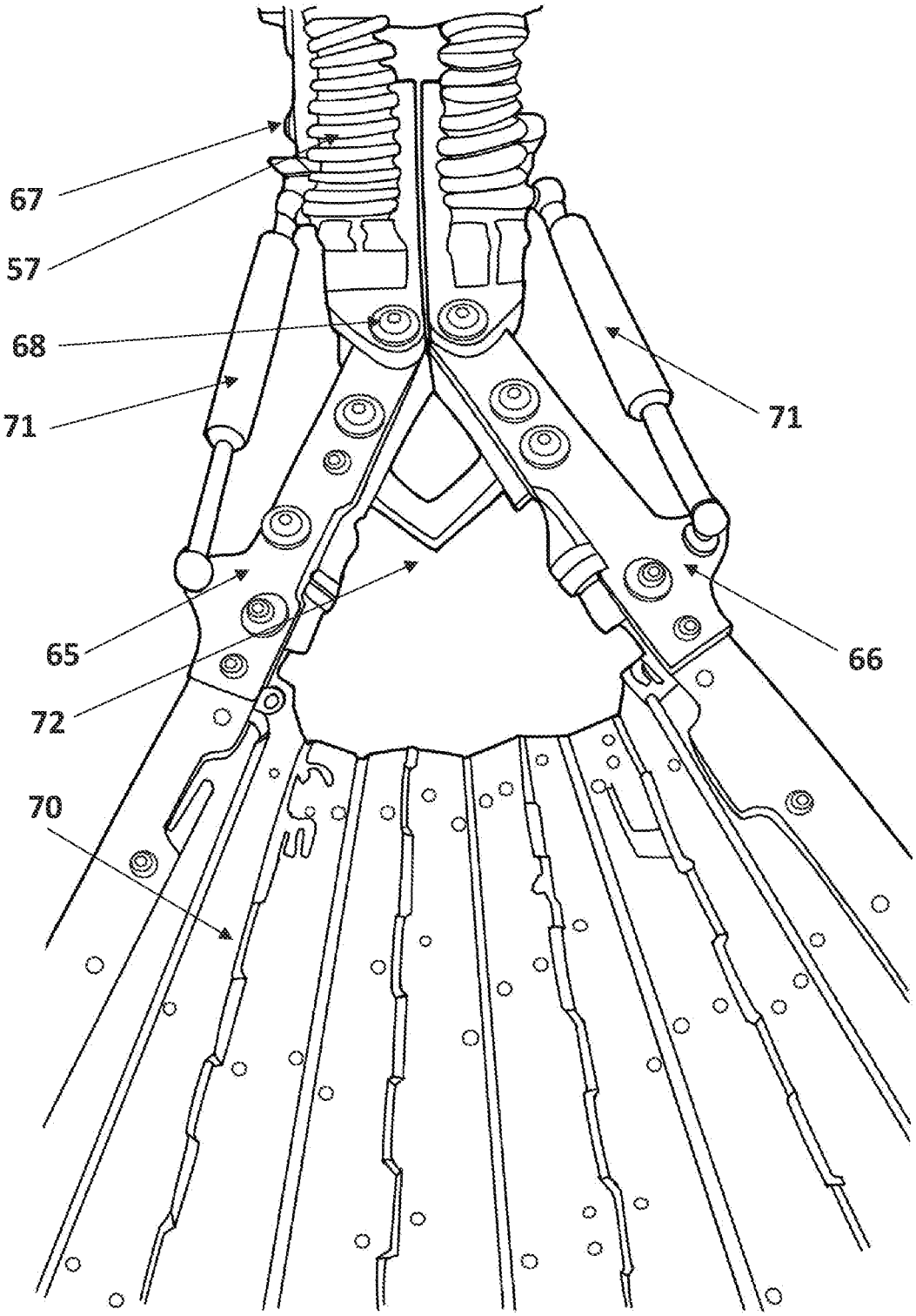
Figure 12:
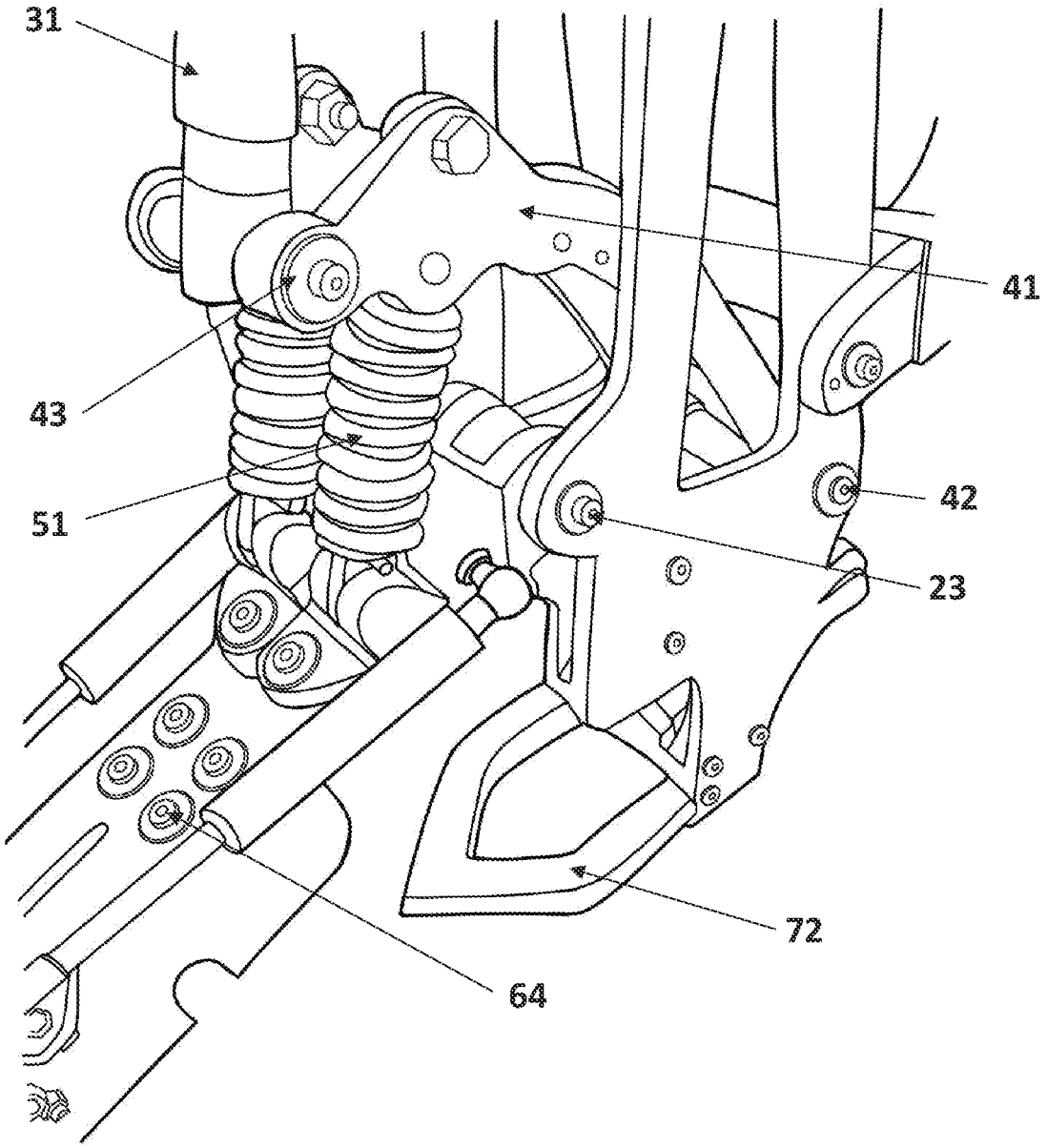
Figure 13:
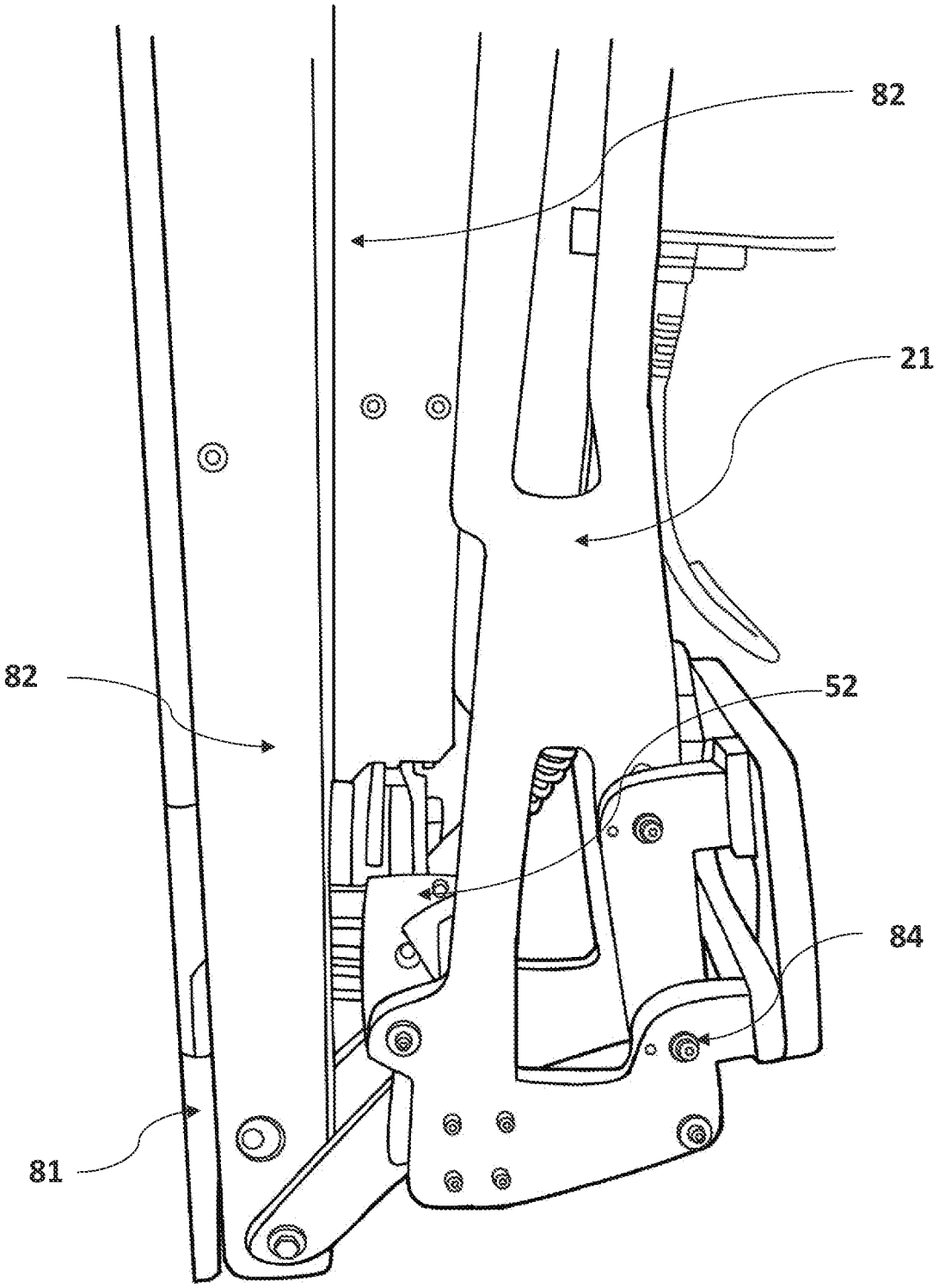
FIGS. 13 to 16 are photographic views of an embodiment of the marine driver system to drive the rigid spike into the waterbed in shallow waters in accordance with an embodiment of this disclosure such as shown in FIGS. 1 to 3 and FIG. 8.
Figure 14:
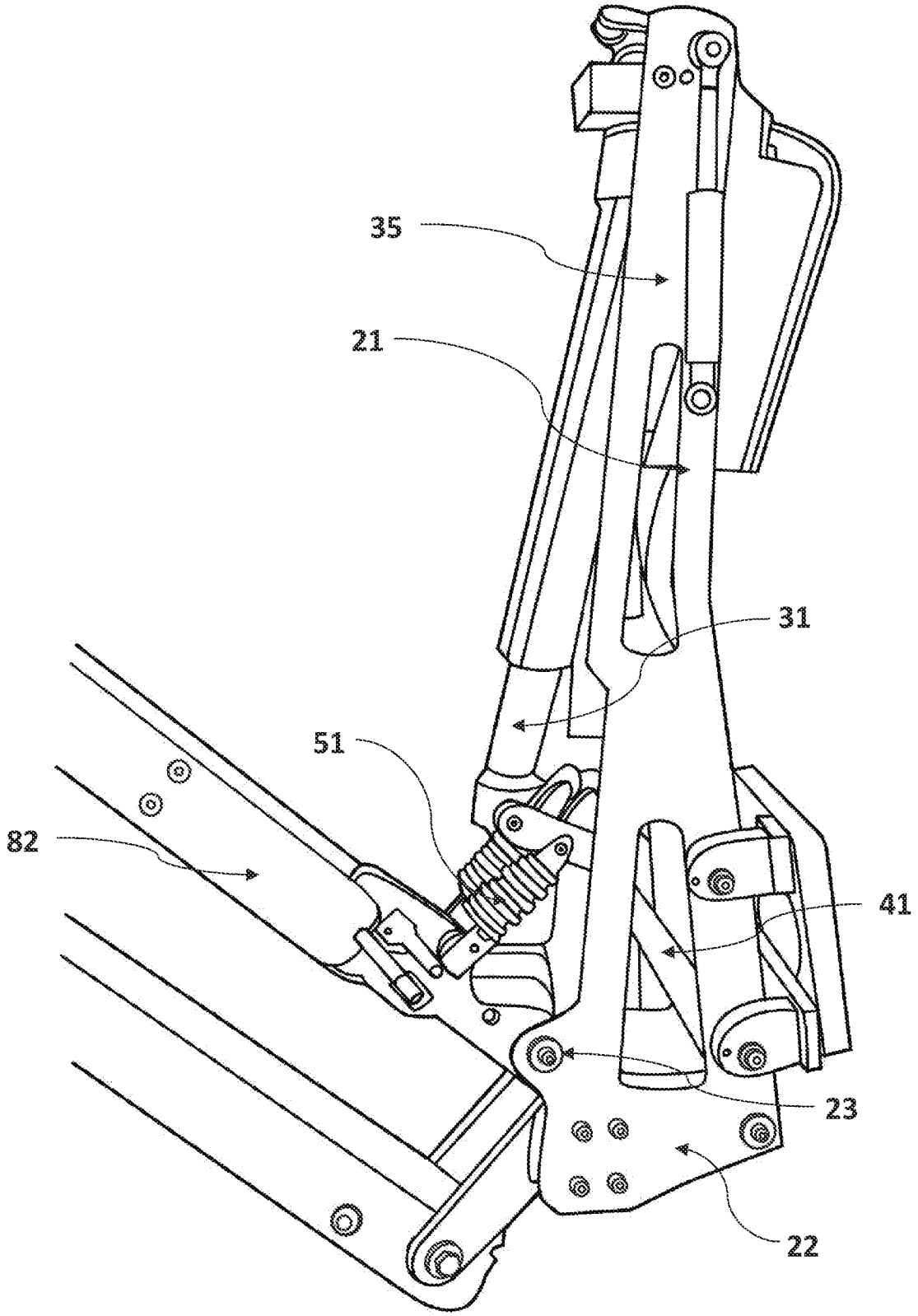
Figure 15:
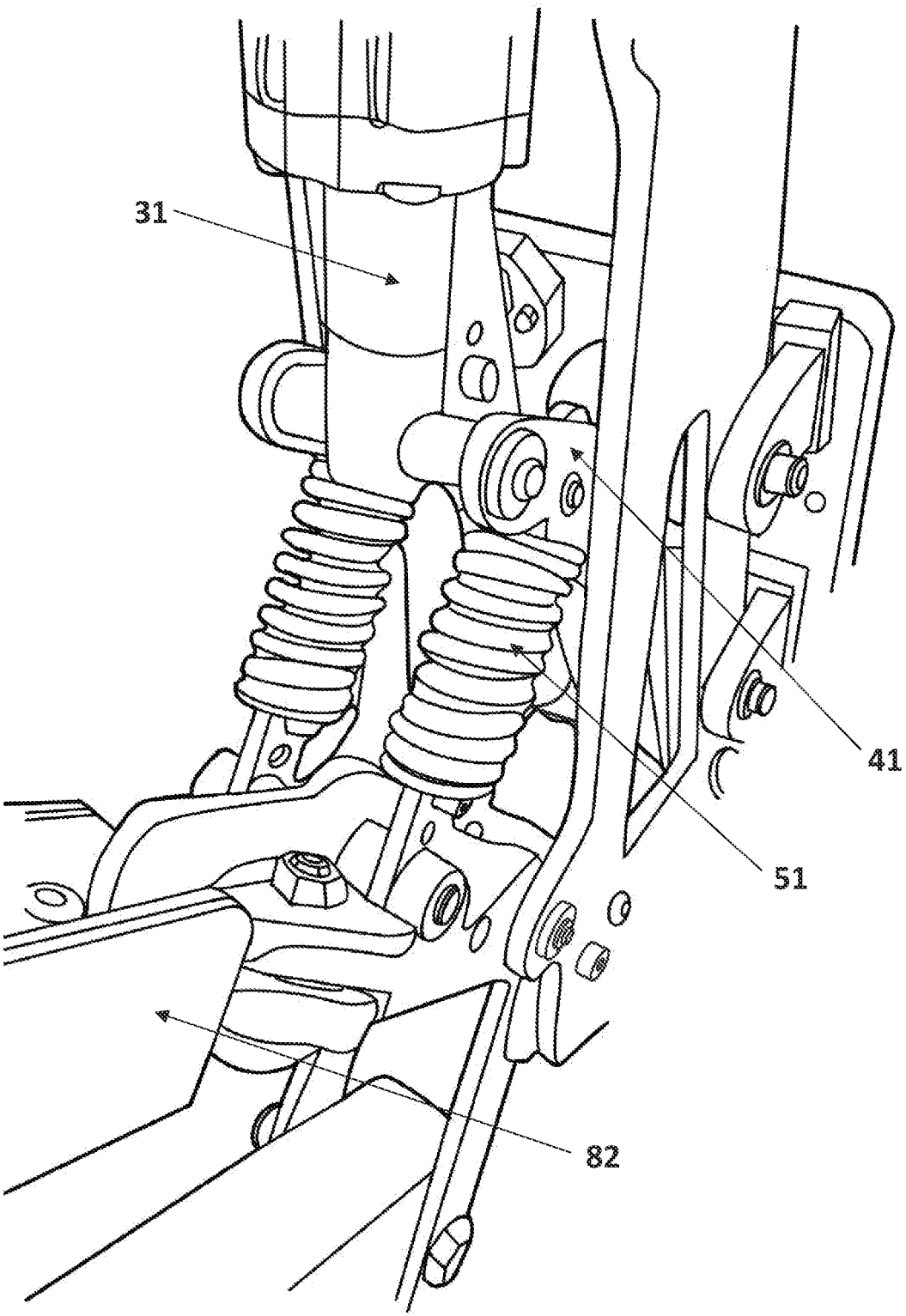
Figure 16:
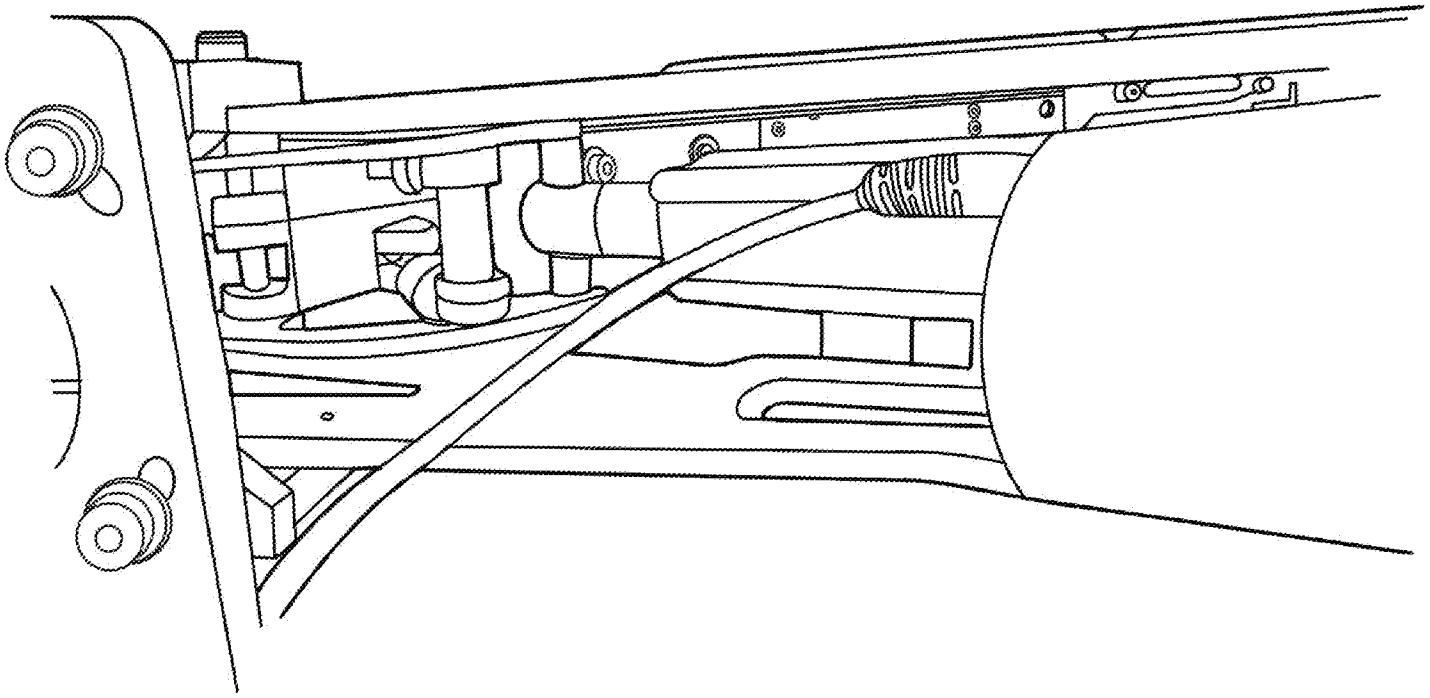

As shown in FIG. 8, the actuator piston pivot shock absorber system 35 is a combination of the pivotal mounting of the linear actuator in slots in the linear body and, as shown in FIG. 14, a shock absorber connecting between the pivot mount and the rigid drive body 21. Therefore, the linear actuator has slight variation in angular drive and protection from expected damaging bumps when applying the work body to its anchoring aims.

Example 1—Rigid Frame Fan Anchor System

Figure 2:
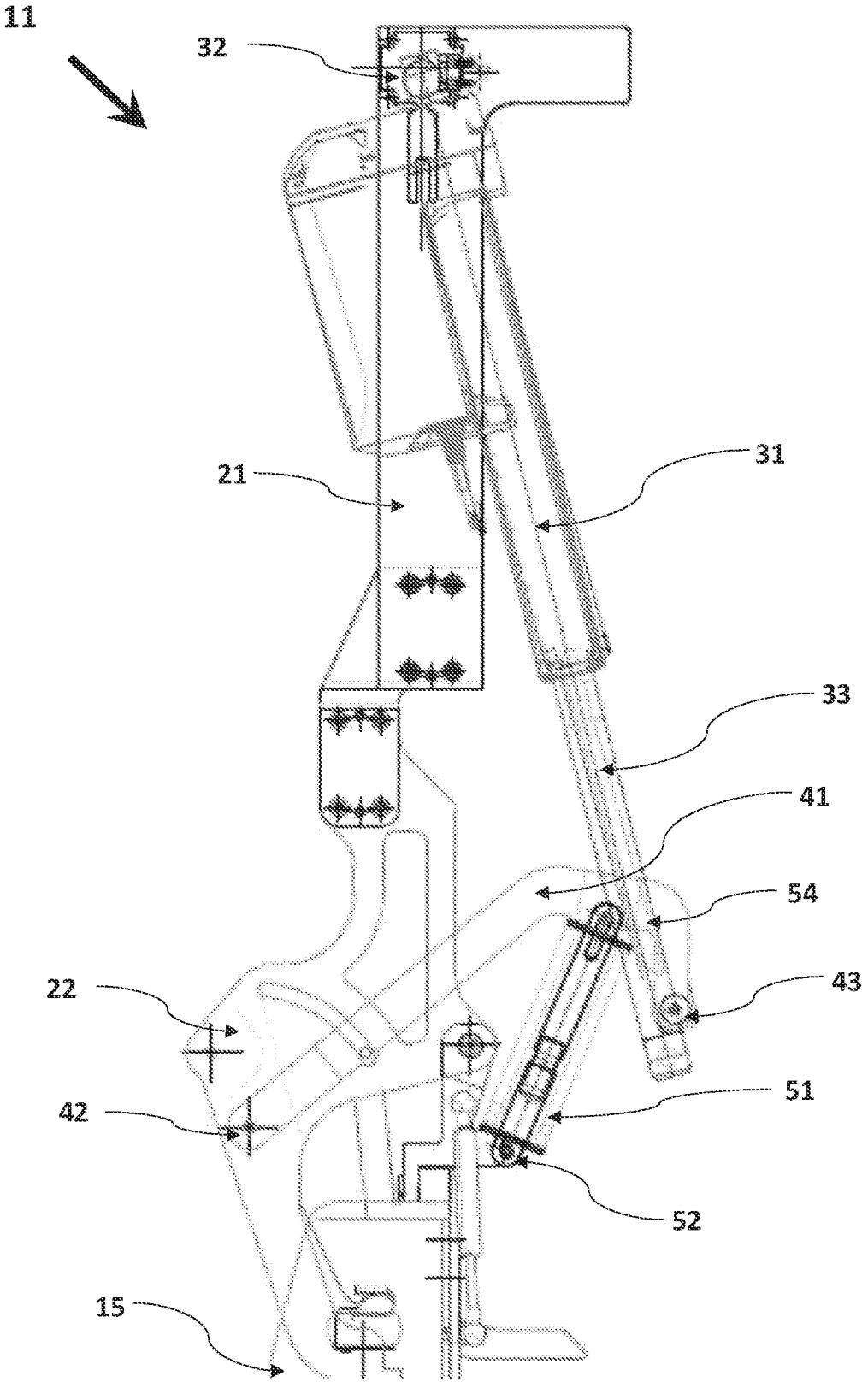

FIGS. 1 to 3 show a marine driver system 11 for rotatably driving a work body 15 relative to a drive body 21. The driver system including a drive body substantially extending in a linear direction forming a reference axis A-A. The work body 15 is pivoted at one end to the drive body 21 at or near the reference axis and in use on a boat is able to be pivoted between a storage position out of the water and an operative position in the water.

A linear actuator 31 is mounted to the drive body 21 at a pivot position 32 spaced to the pivot connection 23 of the work body 15 to the drive body 21. A lever arm 41 having first and second pivot points 42, 43 at distal ends. A drive arm 51 is pivotally mounted on the lever arm 41 at the connection 54 between the first and second pivot points 42, 43 to provide a levered drive of the drive arm 51 by the linear actuator 31.

In this way, the work body 15 is drivably rotatable by the linear actuator 31 substantially 180 degrees or at least an obtuse angle relative to the reference axis to provide a working drive action and to be returnable to a substantially adjacent alignment when rotated back to a storage position.

Figure 4:
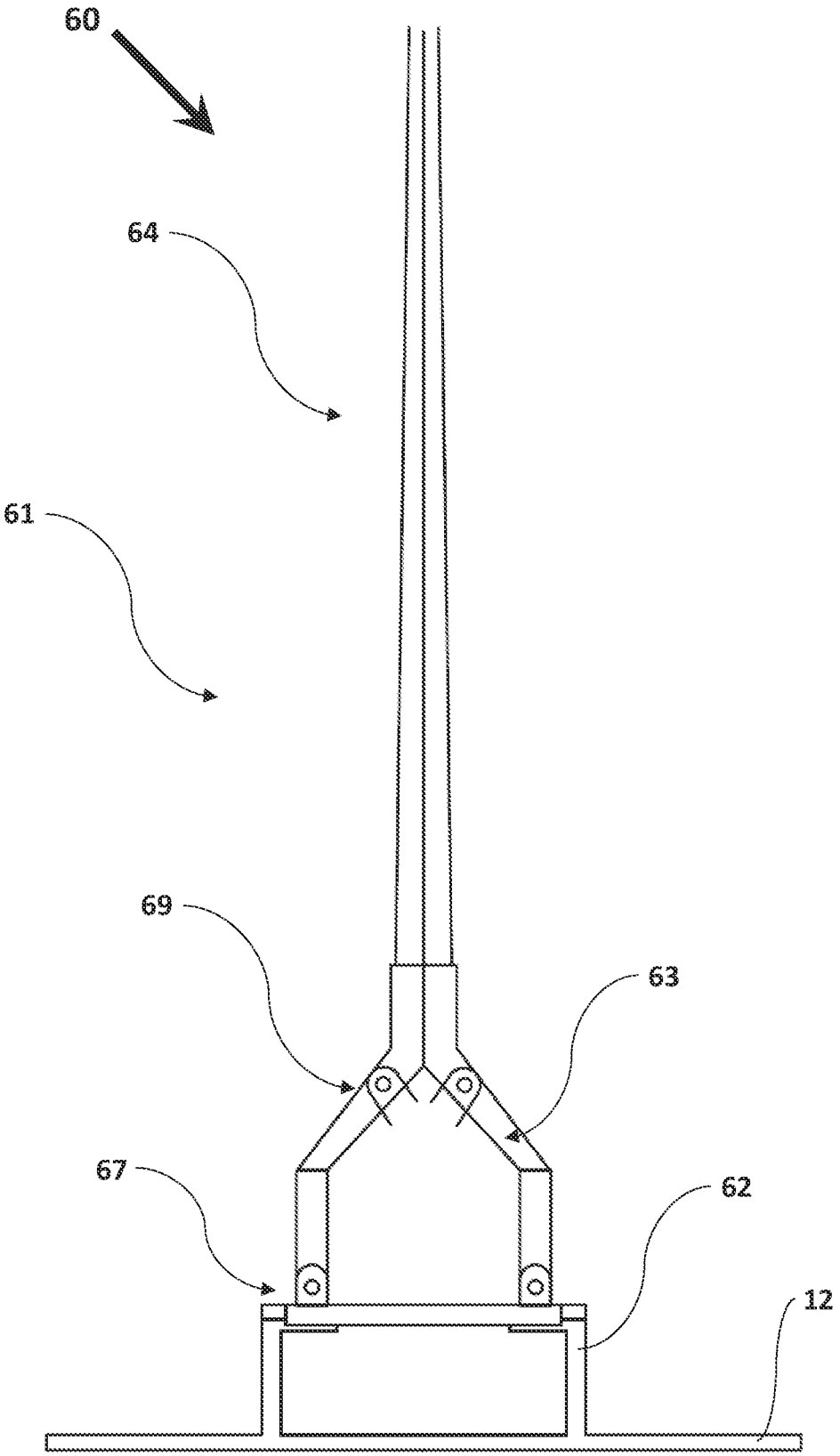
FIGS. 4 to 7 are diagrammatic views of operation of a work body in the form of a rigid body fan anchor for use in the marine driver system to drive the openable fan to an obtuse angle relative to a drive body in accordance with an embodiment of this disclosure.
Figure 5:
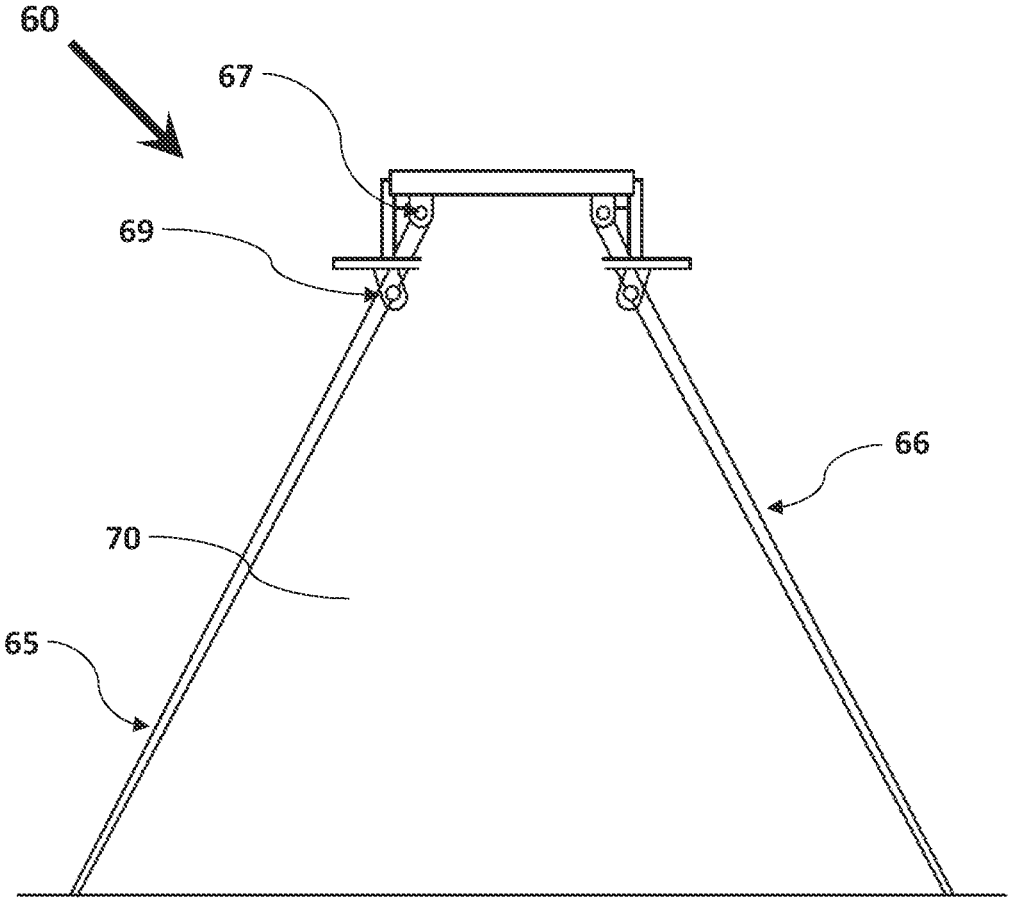
Figure 6:
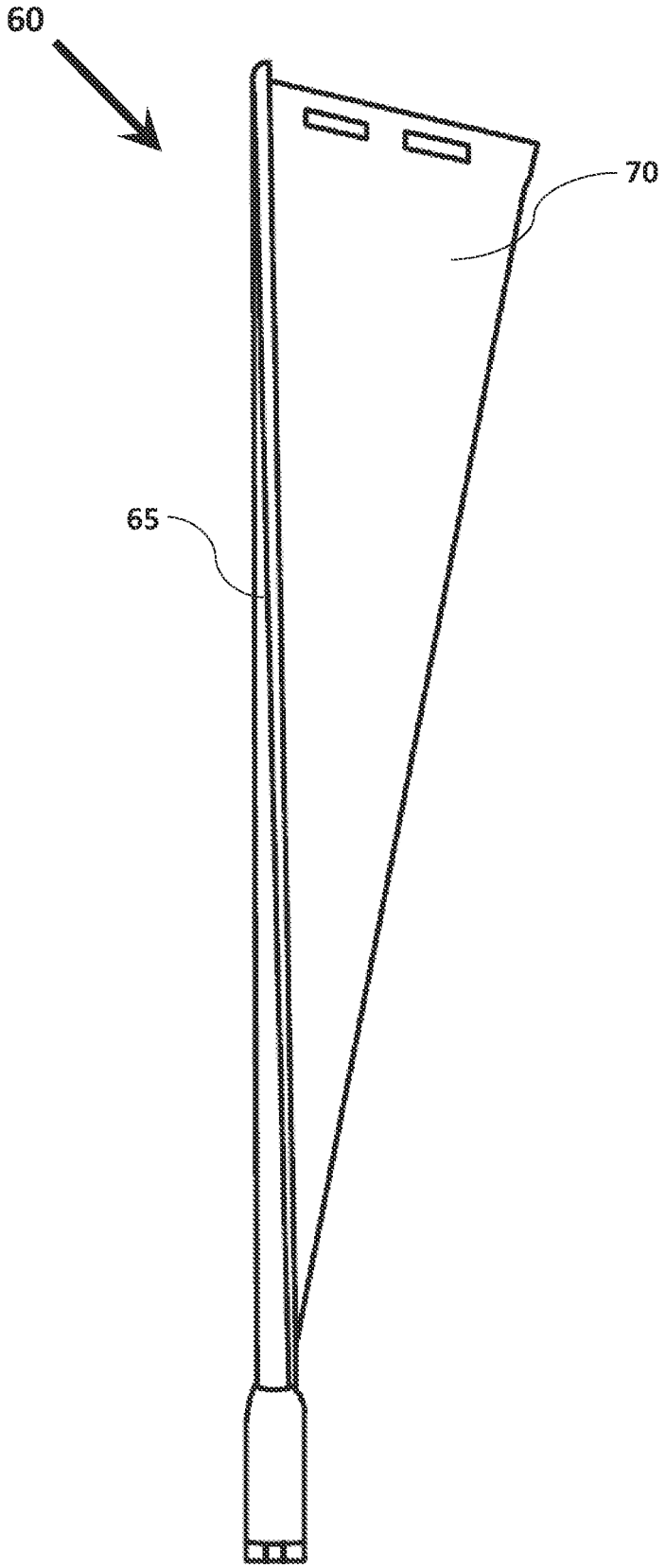
Figure 7:
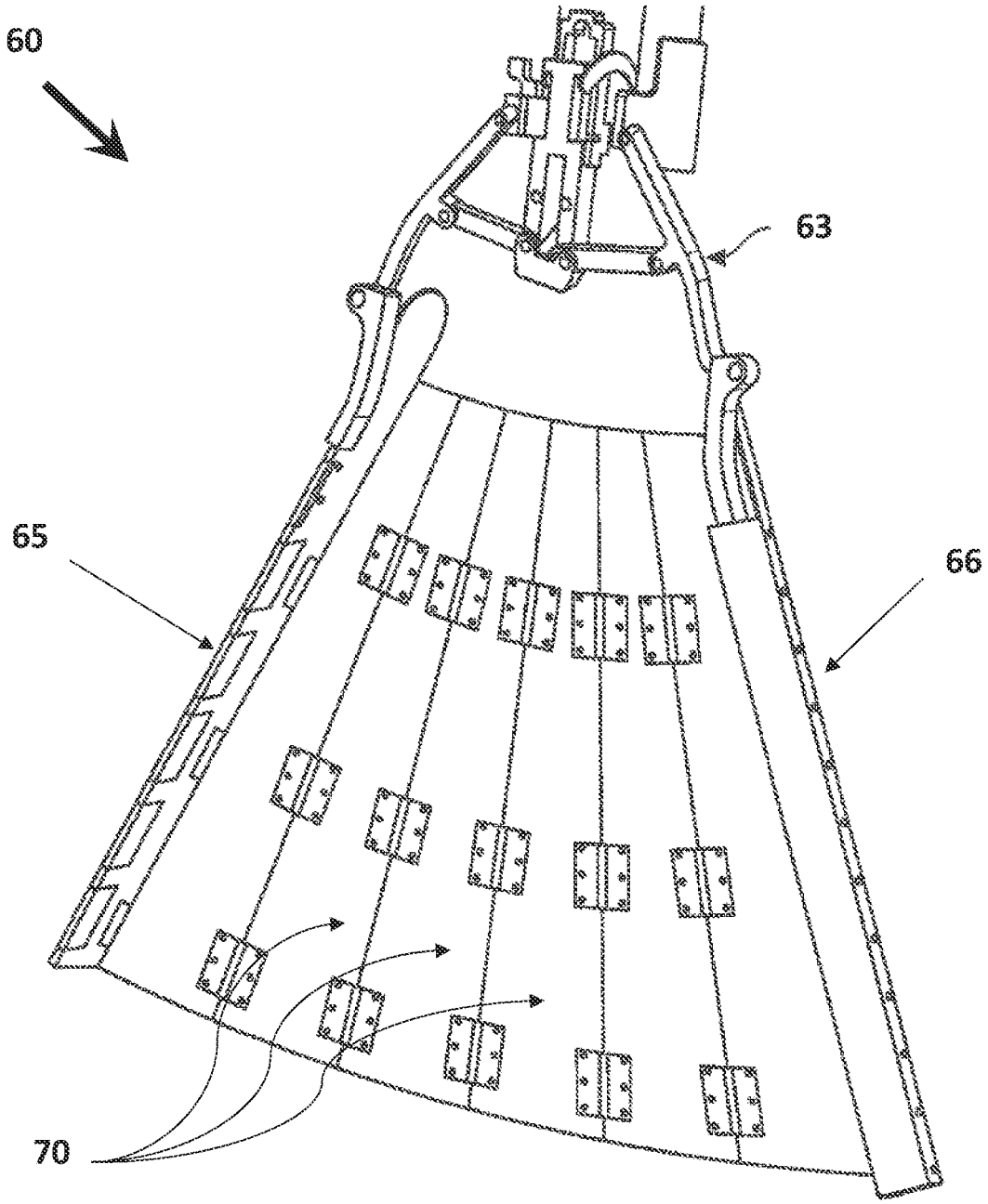

FIGS. 4 to 7 show a variable geometry anchor system 60 also known as a rigid frame fan anchor system acting as the work body 15 in accordance with one embodiment of this disclosure. The anchor system 60 includes a support structure 61 adapted to be adjustably mounted to a deck portion of a boat and operable between a storage position as shown in FIG. 4, where it is substantially upright and retained out of the water and an operating position as shown in FIGS. 5 and 7 expanded and angled below the level of the deck.

The support structure 61 includes a base 62 mountable to the deck internally or externally of the boat 12 and a frame 63, a spinal column of the frame for operably forming at least a portion of a mast assembly 64.

The mast support assembly 64 comprises a pair of mast arms 65, 66 pivotally mounted to the support structure, a vertebrae element, and intermediate pivotal arms interconnecting the vertebrae element and pair of mast arms, forming a variable geometry frame-like structure.

Referring to FIGS. 9 to 12, the vertebrae element of the mast support is displaceably received within the spinal column of the support structure. The vertebrae element is linearly displaceable within the spinal column by an actuator piston operably connected thereto mounted on the support structure.

The mast assembly 64 is displaced linearly downwardly within the spinal column of the mast arms 65, 66 around mast arm pivots 67 so as to move between an upward out of water storage position and an operative downward in water position. However, the mast assembly 64 further includes openable frame pivots such that they can be expanded or contracted with progressive engagement of openable frame deflector 69 around openable frame pivots 68. This deflection is effected by deflector actuators extending between the actuator arm and outside the mast arms to the two mast arms 65, 66. In the uppermost location of the vertebra element within the spinal column, the intermediate arms are folded in a substantially coextending geometry with the spinal column.

As the deflector actuator piston 71 progressively contracts, the vertebrae element is displaced linearly within the spinal column from the uppermost position. As the vertebrae element is displaced away from the uppermost position, the intermediate arms interconnecting the vertebrae element to the pair of mast arms unfold from a coextending position with the spinal column forming an open fan shaped geometry with the spinal column of the support structure. Consequently, the mast support changes geometry as the mast assembly 64 is displaced. As the intermediate arms unfold, as shown, to form a fan shape geometry with the spinal column, the pivotally connected pair of mast arms 65, 66 are displaced outwardly laterally.

The pair of mast arms 65, 66 of the mast support assembly support a sheet material 70 or slatted structure that spans the mast arms and operable between a closed condition and a fully opened condition. In one embodiment shown in FIG. 7, there is illustrated a concertina structure mounted by the mast arms in a closed storage condition. The concertina structure comprises a series of shaped slats joined by hinged elements so that each slat is adapted to fold against its neighboring slat element. As the pair of mast arms 65, 66 is displaced outwardly laterally with the change in geometry of the spinal column and vertebrae element to an open fan shape configuration.

The extent to which the drogue element can be opened is controlled by the actuator piston, and the angle of the drogue is also adjustable by a second actuator. So, depending on the prevailing conditions, the angle of the drogue is adjustable in the vertical and horizontal planes so that rate and angle of drift can be controlled.

The pair of mast arms are pivotally located on the support structure, and intermediate arms pivotally connected to the vertebrae element and the mast arms, so that when the vertebrae element is displaced within the spinal column by the actuator arm, the intermediate arms move outwardly laterally of the support structure.

Example 2—Spike Anchor System

Spike anchor systems are used in the shallow water anchors. The conventional hydraulic shallow water anchor systems have one or more of the following listed issues:

- 12-volt hydraulic pump and lines to be fitted internally into boat;
- arms tend to wobble around and don't lock into place when in closed position particularly as they age;
- once the spike has been driven down, it does not move up or down to follow the movement of the boat, e.g., movement caused via waves. Some prior art does redrive using hydraulic pressure, which is flawed;
- If the boat or tide drops once deployed, the full load is forced on the spike, which can cause it to become irretrievably stuck (in the mud);
- No sensor to detect soft bottom and spike overdeploys and becomes stuck in soft bottom, e.g., mud; and
- No dampener system so when deployed in rough water, arms bounce around violently.

A rotating work frame of the work body 15 in the form of a spike anchor 80 includes a parallelogram driving arm 82 and the linear spike 81, which are pivotally mounted at one end at pivot connection 84 to a lower drive body 22 substantially extending in a linear direction forming a reference axis. The spike 81 is pivotally mounted at pivot point 83 to a second distal end of the parallelogram driving arm 82 of the work body spaced from the drive body 21 and to allow the spike to hang downwards and be driven down into the waterbed.

A linear actuator 31 is mounted to the work body 15 at a position spaced to the pivot connection 84 of the work frame to the drive body and at a higher position so as to remain out of the water.

A lever arm 41 having first and second pivot points at distal ends is connected to drive arm 51 pivotally mounted on the lever arm in a position between the first and second pivot points 42, 43 to provide a levered drive of the drive arm by the linear actuator. In this way the spike 81 can be drivably pivoted between a storage position out of the water and an operative position in the water.

The spike parallelogram drive frame of the spike anchor system ensures strength.

However, the development was to provide carbon-fiber arms and attachment pivot points and adapted the arms to the current drive mechanism. This results in a spike anchor system having a spike 81 for driving into a waterbed when in use on a boat in shallow waters.

A sensor 85 is located on the distal end of the spike 81 at or near the pivot point 83 to be able to sense the rise and fall of the water by boat movement on waves and due to tidal changes so as to pre-empt depth to waterbed and avoid excessive weight on the spike, which causes embedding.

The operation of the marine driver system is shown in FIGS. 17 to 20 in which there are photographic views of progressive states of opening of a marine driver system in accordance with the disclosure with a work body being a parallelogram frame with a pivoting spike.

Figure 17:
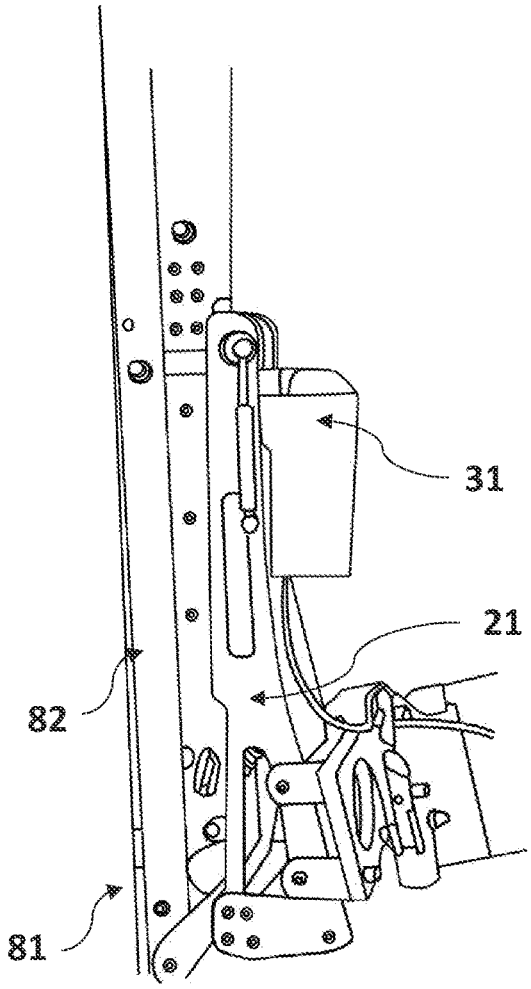
FIGS. 17 to 20 are photographic views of progressive states of opening of a marine driver system in accordance with the disclosure with a work body being a parallelogram frame with pivoting spike.
Figure 18:
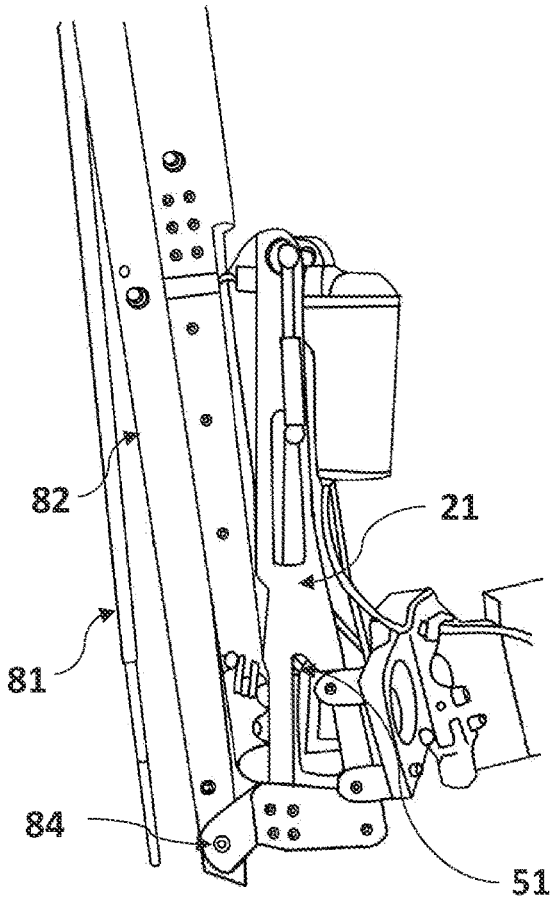

In FIG. 17, the spike 81 and parallelogram driving arm 82 form the work body and are in a storage position coextending and clipped to the elongated drive body mounted vertically on the back of a boat. As shown in FIG. 18, after unclipping, the parallelogram frame 82, which is pivotally connected at a lower end of the drive body 21, falls away from the drive body. Similarly, the spike 81, which is pivotally connected to the other end of the parallelogram driving arm 82, pivots away and remains vertical.

Figure 19:
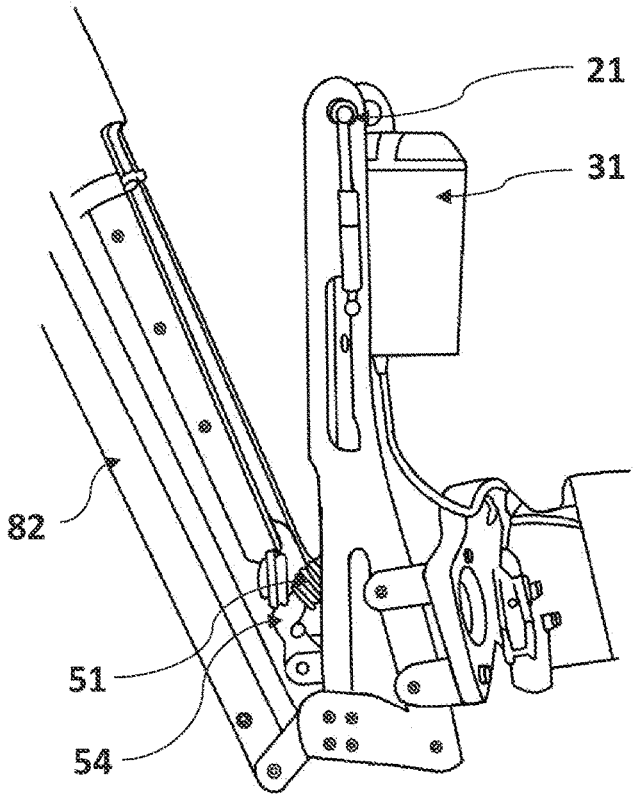
Figure 20:
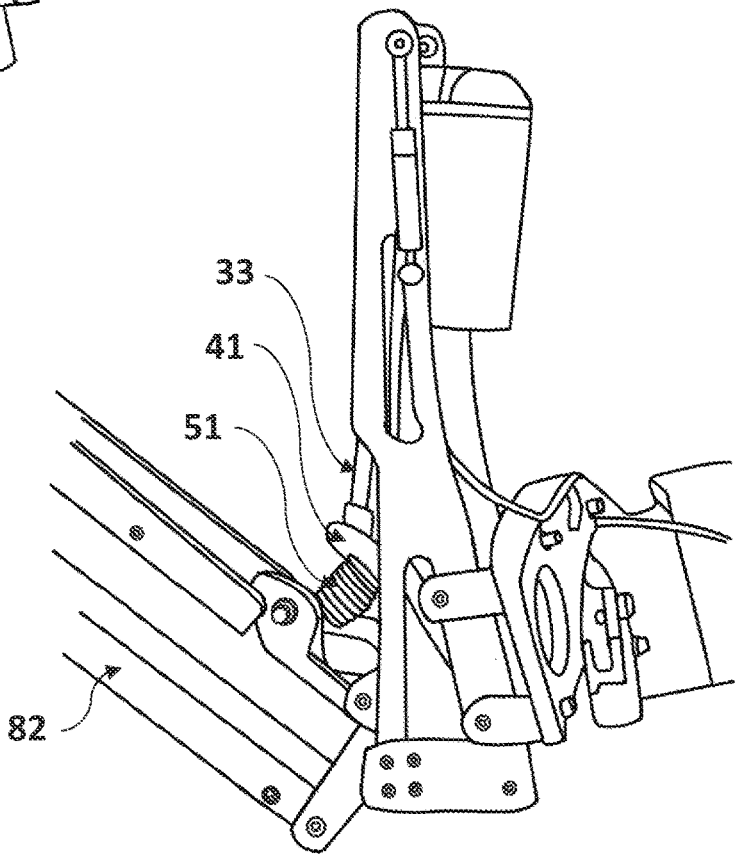

In FIGS. 19 and 20, the effects of the linear actuator 31 extending its actuator piston 33 is driving the drive arm 51 through connection between the pivotally mounted lever arm 41 and the parallelogram driving arm 82. This forces the parallelogram driving arm 82 to rotate away from the fixed drive body 21 and allowing the spike to continue to pivot and remain substantially vertical. It can be seen that the geometry and pivotal connection of the spike 81 to the parallelogram driving arm 82 results in a driving motion of the spike into the shallow seabed or riverbed or sandbar below the boat to perform the anchoring effect.

The benefits of the spike anchor system over the competition includes:

- 12-volt electric vs hydraulic;
- redrive system with springs can redrive up to 500 mm once deployed to hold to the bottom if boat moves up or down with waves, etc.;
- if boat drops due to tide or waves, the springs can compress up to 500 mm, preventing overdriving of the spike;
- has a built-in dampener system that stops arms bouncing up and down when deploying or retracting arms;
- arms are locked in place when fully retracted and centered every time in the closed position;
- ultrasonic sensor prevents overdrive into soft mud so spike cannot become stuck; sensor also allows for increased down force to be applied in a harder substrate/bottom for better holding capacity;
- carbon-fiber arms are super light and strong and are four times stronger than aluminum;
- complete unit is significantly lighter than the competition; and
- deployment and retraction speed faster and quieter than competition.

Similar actions shown in FIGS. 17 to 20 of the marine driver system applies when the attached work body is a fan anchor, which includes an openable rigid frame fan anchor. In this embodiment, the rigid frame fan anchor is drivably rotatable by the linear actuator substantially 180 degrees or at least an obtuse angle relative to the reference axis from a closed storage position to an open fan anchor position and returnable to a substantially adjacent alignment when rotated back to the closed storage position. In a first part of the driven rotation of the rigid frame fan anchor rotates by the linear actuator from the upright closed storage position and in a second part of the driven rotation by the linear actuator the rigid frame fan anchor further rotates towards the open fan anchor position. The second part of the driven rotation by the linear actuator causes the frame of the openable rigid frame fan anchor to engage against a projecting deflector locking arm at the base of the drive body to open the fan anchor to the open fan anchor position.

Other improvements would be understood by a person skilled in the art.

Interpretation

EMBODIMENTS

Reference throughout this specification to "one embodiment" or "an embodiment" means that a particular feature, structure or characteristic described in connection with the embodiment is included in at least one embodiment of this disclosure. Thus, appearances of the phrases "in one embodiment" or "in an embodiment" in various places throughout this specification may or may not necessarily all refer to the same embodiment. Furthermore, the particular features, structures or characteristics may be combined in any suitable manner, as would be apparent to one of ordinary skill in the art from this disclosure, in one or more embodiments.

Similarly, it should be appreciated that in the above description of example embodiments of the disclosure, various features of the disclosure are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed disclosure requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this disclosure.

Furthermore, while some embodiments described herein include some but not other features included in other embodiments, combinations of features of different embodiments are meant to be within the scope of the disclosure, and form different embodiments, as would be understood by those in the art. For example, in the following claims, any of the claimed embodiments can be used in any combination.

Different Instances of Objects

As used herein, unless otherwise specified the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

Specific Details

In the description provided herein, numerous specific details are set forth. However, it is understood that embodiments of the disclosure may be practiced without these specific details. In other instances, well-known methods, structures and techniques have not been shown in detail in order not to obscure an understanding of this description.

Terminology

In describing embodiments of the disclosure illustrated in the drawings, specific terminology will be resorted to for the sake of clarity. However, the disclosure is not intended to be limited to the specific terms so selected, and it is to be understood that each specific term includes all technical equivalents that operate in a similar manner to accomplish a similar technical purpose. Terms such as "forward," "rearward," "radially," "peripherally," "upwardly," "downwardly," and the like, are used as words of convenience to provide reference points and are not to be construed as limiting terms.

Comprising and Including

In the claims that follow and in the preceding description of the disclosure, except where the context requires otherwise due to express language or necessary implication, the word "comprise" or variations such as "comprises" or "comprising" are used in an inclusive sense, i.e., to specify the presence of the stated features but not to preclude the presence or addition of further features in various embodiments of the disclosure.

Any one of the terms: "including" or "which includes" or "that includes" as used herein is also an open term that also means "including at least" the elements/features that follow the term, but not excluding others. Thus, "including" is synonymous with and means "comprising."

Scope of Disclosure

Thus, while embodiments of the disclosure have been described, those skilled in the art will recognize that other and further modifications may be made thereto without departing from the spirit of the disclosure, and it is intended to claim all such changes and modifications as fall within the scope of the disclosure. For example, any formulas given above are merely representative of procedures that may be used. Functionality may be added or deleted from the block diagrams and operations may be interchanged among functional blocks. Steps may be added or deleted to methods described within the scope of this disclosure.

Although the disclosure has been described with reference to specific examples, it will be appreciated by those skilled in the art that the disclosure may be embodied in many other forms.

INDUSTRIAL APPLICABILITY

It is apparent from the above, that the arrangements described are applicable to the marine industry and particularly the marine anchor industry.

| ITEM list | |
|---|---|
| 11 | Marine driver |
| 12 | boat |
| 15 | Work body |

-continued

| ITEM list | |
|---|---|
| 21 | drive body |
| 22 | Lower drive body |
| 23 | pivot |
| 31 | Linear actuator |
| 32 | pivot |
| 33 | Actuator piston |
| 34 | Actuator Piston pivot |
| 35 | Actuator Piston pivot shock absorber |
| 41 | Lever arm |
| 42 | First end—Lever arm mount |
| 43 | Second end |
| 51 | Drive arm |
| 52 | Drive arm mount |
| 53 | Drive body |
| 54 | Drive arm pivot |
| 55 | Pivot slot pin |
| 56 | slot |
| 57 | spring |
| 60 | variable geometry anchor system |
| | 60 also known as a rigid frame fan anchor system |
| 61 | support structure |
| 62 | a base 62 |
| 63 | An openable frame 63 |
| 64 | a mast assembly 64 |
| 65 | mast arms |
| 66 | mast arms |
| 67 | mast arms pivot |
| 68 | openable frame pivots |
| 69 | openable frame deflector |
| 70 | Fan |
| 71 | Deflector actuators |
| 72 | Deflector locking arm |
| 80 | Spike anchor |
| 81 | spike |
| 82 | Parallelogram driving arm |
| 83 | Pivot mount of spike |
| 84 | Pivot connection to drive body |
| 85 | sensor |
| 86 | brace |

The claims defining the invention are as follows:

1. A marine driver system for driving a work body pivotally connected to a drive body, the driver system including:

a. a drive body substantially extending in a linear direction forming a reference axis;

b. a work body pivoted at one end to the drive body at a pivot connection at or near the reference axis;

c. a linear actuator having first and second opposing ends and mounted at the first opposing end to the work body at a position spaced to the pivot connection of the work body to the drive body;

d. a lever arm having first and second pivot points at respective distal ends of the lever arm, the lever arm pivotally mounted at the first pivot point to the drive body and pivotally mounted at the second pivot point to the second opposing end of the linear actuator; and e. a drive arm pivotally mounted at one end on the lever arm and pivotally connected at the other end of the drive arm to the work body;

wherein drive or retraction of the linear actuator provides a levered drive of the drive arm and driving or retracting of the pivotally connected work body, wherein the work body is a fan anchor, wherein the fan anchor includes an openable rigid frame fan anchor, and wherein in a first part of a driven rotation by the linear actuator, the openable rigid frame fan anchor rotates from an upright closed storage position and, in a second part of the driven rotation by the linear actuator, the openable rigid frame fan anchor further rotates toward an open fan anchor position.

2. The driver system according to claim 1, wherein the drive arm is pivotally connected at a position between the first and second pivot points and pivotally connected at the other end of the drive arm to the work body.

3. The driver system according to claim 1, wherein the lever arm is a non-linear lever arm that is pivotally mounted at the first pivot point to the work body on a first side of the reference axis and pivotally mounted at the second pivot point to the second opposing end of the linear actuator on the opposite side of the reference axis, wherein the lever arm is a curved non-linear arm extending at least partially around the one end of the work body.

4. The driver system according to claim 1, wherein the lever arm is pivotally mounted at the first pivot point to the work body on a first side of the reference axis and wherein the lever arm is pivotally mounted at the second pivot point to the second opposing end of the linear actuator on the opposite side of the reference axis, wherein the drive arm is pivotally mounted on the lever arm in a non-linear position between the first and second pivot points to provide a levered drive of the drive arm by the linear actuator.

5. The driver system according to claim 1, wherein the drive arm is pivotally mounted on the lever arm in a non-linear position between the first and second pivot points to provide a levered drive of the drive arm by the linear actuator.

6. The driver system according to claim 1, wherein the drive arm includes a guide mechanism allowing for limited relative movement of the drive arm to the lever arm and a resilient mechanism wherein the work body is able to move resiliently relative to the linear actuator and/or drive arm over a limited compressive distance and self-return to an operative position.

7. The driver system according to claim 6, wherein the guide mechanism of the drive arm includes a guide channel for receiving a guide pin guide to define the limited relative movement of the drive arm to the lever arm, and wherein the guide mechanism of the drive arm includes a guide rail for engaging a guide rail member to define the limited relative movement of the drive arm to the lever arm.

8. The driver system according to claim 6, wherein the resilient mechanism includes a spring, wherein the spring of the resilient mechanism encircles the drive arm.

9. The driver system according to claim 1, wherein the work body is drivably rotatable by the linear actuator substantially 180 degrees or at least an obtuse angle relative to the reference axis to provide a working drive action and returnable to a substantially adjacent alignment when rotated back to a storage position.

10. The driver system according to claim 9, wherein mounting of the linear actuator mounted to the work body at a position spaced to the pivot connection of the work body to the drive body is a resilient pivoting connection allowing a resilient shock absorbing mount of the linear actuator.

11. The driver system according to claim 1, wherein the openable rigid frame fan anchor is drivably rotatable by the linear actuator substantially 180 degrees or at least an obtuse angle relative to the reference axis from a closed storage position to an open fan anchor position and returnable to a substantially adjacent alignment when rotated back to the closed storage position, and wherein an opening of the openable rigid frame fan anchor includes the second part of the driven rotation by the linear actuator effecting a frame of the openable rigid frame fan anchor to engage against a projecting deflector locking arm at a base of the drive body to open the fan anchor to the open fan anchor position.

12. The driver system according to claim 1, wherein the drive arm includes a guide mechanism allowing for limited relative movement of the drive arm to the lever arm and a resilient mechanism, wherein the work body is able to move resiliently relative to the linear actuator and/or drive arm over a limited compressive distance and self-return to an operative position, wherein the guide mechanism of the drive arm includes a guide channel for receiving a guide pin guide to define the limited relative movement of the drive arm to the lever arm.

13. The driver system according to claim 12, wherein the guide mechanism of the drive arm includes a guide rail for engaging a guide rail member to define the limited relative movement of the drive arm to the lever arm.

14. The driver system according to claim 12, wherein the resilient mechanism includes a spring wherein the spring of the resilient mechanism encircles the drive arm.

15. A method of driving a work body through a pivoting angle relative to a drive body including the steps of:

a. providing a pivotal mounting of a work body such that it can pivot up to 180 degrees;

b. mounting a drive body at a spaced position above the pivotal mounting of the work body;

c. pivotally mounting a first end of an elongated lever arm and pivotally mounting a second end to an operative end of a linear actuator; and d. providing a drive arm from the work body to a leverage position on the elongated lever arm between the first end and the second end, wherein the work body is drivably rotatable substantially 180 degrees or at least an obtuse angle relative to a reference axis to provide a working drive action and returnable to a substantially adjacent alignment when rotated back to a storage position, wherein the drive body provides a linear drive on the elongated lever arm to effect by an offset drive arm connection to the elongated lever arm and rotation of the work body to an operative position, wherein the drive arm is resiliently mounted to the elongated lever arm allowing limited relative movement wherein the resilient mounting allows limited bounce and return to the operative position, and wherein the work body is a spike anchor.

16. A spike anchor system having:

a. a spike for driving into a waterbed when in use on a boat in shallow waters;

b. a rotating work frame pivotally mounted at one end to a drive body substantially extending in a linear direction forming a reference axis, and wherein the spike is pivotally mounted to a second distal end of the drive body;

c. a linear actuator mounted to the spike at a position spaced to a pivot connection of the rotating work frame to the drive body;

d. a lever arm having first and second pivot points at distal ends, and pivotally mounted at the second pivot point to an end of the linear actuator; and e. a drive arm pivotally mounted on the lever arm in a position between the first and second pivot points to provide a levered drive of the drive arm by the linear actuator, wherein the spike can be drivably pivoted between a storage position out of the water and an operative position in the water, and wherein the rotating work frame includes a parallelogram drive frame.

17. The spike anchor system according to claim 16, wherein a pivoting spike is linearly drivable by rotatable action effected by the linear actuator substantially 180 degrees or at least an obtuse angle relative to the reference axis from the storage position while in use on a boat out of water to an operative driven spike anchor position through the water into a waterbed and returnable to a substantially adjacent alignment when rotated back to the storage position.

18. The spike anchor system according to claim 16, wherein the spike includes an extended elongated linear spike pivotally mounted at one end.

* * * * *